US006082796A

United States Patent [19]

Scaglia

[11] Patent Number: 6,082,796

[45] Date of Patent: Jul. 4, 2000

[54] DEVICE TO GRIP AND MANIPULATE BOBBINS OF TEXTILE THREAD

[75] Inventor: Enzo Scaglia, Milan, Italy

[73] Assignee: Scaglia SpA, Brembilla, Italy

[21] Appl. No.: 09/061,126

[22] Filed: Apr. 16, 1998

[30] Foreign Application Priority Data

Apr. 17, 1997 [IT] Italy ..... UD97A0074

[51] Int. Cl.[7] ..... B65H 75/14; B65H 49/00

[52] U.S. Cl. ..... 294/94; 242/573.9

[58] Field of Search ..... 294/94, 93, 95, 294/86.1, 86.25, 100; 57/274, 275, 281; 242/130, 130.1, 132, 134, 573.7, 573.9; 112/231; 223/106

[56] References Cited

U.S. PATENT DOCUMENTS

| | | | |
|---|---|---|---|
| 216,666 | 6/1879 | Fay | 242/130 |
| 1,678,806 | 7/1928 | Colman | 242/130 |
| 3,143,308 | 8/1964 | Besnyo | 242/573.7 |
| 3,811,608 | 5/1974 | Olney | 223/106 |
| 3,850,394 | 11/1974 | Raasch et al. | 242/130 |
| 4,043,097 | 8/1977 | Ishida et al. | 53/52 |
| 4,360,172 | 11/1982 | Cope | 242/134 |
| 4,777,792 | 10/1988 | Marzoli | 57/275 |

FOREIGN PATENT DOCUMENTS

| | | | |
|---|---|---|---|
| 3702276 | 7/1987 | Germany . | |
| 9004868 | 8/1991 | Germany . | |
| 4119827 | 12/1992 | Germany . | |
| 1316971 | 6/1987 | U.S.S.R. | 294/94 |
| 1449515 | 1/1989 | U.S.S.R. | 294/95 |

*Primary Examiner*—Dean J. Kramer
*Assistant Examiner*—Paul T. Chin
*Attorney, Agent, or Firm*—Antonelli, Terry, Stout & Kraus, LLP

[57] ABSTRACT

Device to grip and manipulate bobbins of textile thread, used to grip, move and transport cops (10) after the textile thread has been wound on, the cops (10) having an inner cavity **(10*c*) and flanges (10*b*) at the ends, the device being suitable to cooperate with at least one end of the cop (10), the end of the cop (10) including toothed clamping means (18) protruding therefrom and facing outwards, the gripper device including at least a central body (13) suitable to be inserted at least partly inside the inner cavity (10*c*) of the cop (10) and cooperating with the wall of the inner cavity (10*c*), the central body (13) being associated with an elastic type clamp/release device governed by the activation of at least a drive button (14)**, the clamp/release device including a first position of elastic clamping and a second release position.

8 Claims, 2 Drawing Sheets

DEVICE TO GRIP AND MANIPULATE BOBBINS OF TEXTILE THREAD

BACKGROUND OF THE INVENTION

This invention concerns a device to grip and manipulate bobbins of textile thread.

The invention is applied in the textile field to grip, lift and transport the bobbins of textile thread after the thread has been wound thereon.

The bobbins to which the invention refers are of the type which include a core or support, commonly known as cops, onto which the textile thread is wound in coils; the cops are substantially cylindrical in shape with flanges at the two ends; normally they are small and, when the thread is wound on, they weigh around a few kilograms.

The state of the art includes cores or supports onto which the textile thread is wound in coils, whether the thread be natural, synthetic or mixed.

There are supports which are commonly known as cops made of plastic or metallic material according to the type of thread to be wound; they have a cylindrical body with flanges at the ends to contain the wound textile thread.

Despite the fact that the textile industry is becoming increasingly automated, it is also known that, in some cases and/or for certain processes, in some textile machines the cops of thread are still lifted, transported and loaded/unloaded manually.

These manual operations to lift and/or transport and/or load/unload the cops are extremely difficult inasmuch as the cops have no means for the operator to grip.

This problem becomes even more serious if we consider that, for example when synthetic threads are being wound, the cops are extremely heavy and slippery, which may cause the workers considerable operational problems.

In those cases when the cops are moved by automated devices, it is extremely complex and risky for the safety of the wound thread to connect a gripper device to the cop. Moreover, in some cases moving the cops manually may damage the surface layers of the wound thread both from the mechanical point of view, as the coils may possibly overlap or become tangled, and also from the point of view of quality, as the thread is easily dirtied when it is manipulated manually.

SUMMARY OF THE INVENTION

The present applicant has designed and embodied this invention to facilitate and make less onerous the operations to manipulate the cops of textile thread, and to achieve further advantages.

The purpose of the invention is to provide a simple, economical and functional solution for a device to grip and manipulate cops of textile thread which will simplify and facilitate the operations to move the cops of textile thread manually.

A further purpose is to provide a gripper and manipulation device which can be associated with automatic transport devices.

A further purpose is to provide a gripper device which will ensure a temporal constraint with the cop which is stable enough to guarantee that the cop will not be accidentally unconstrained and released, even when there are relatively heavy weights involved and/or in difficult conditions of manipulation and transport.

The gripper and manipulation device according to the invention substantially consists of gripper means for the operator, for example a handle, a hook, a hand grip, etc. and rapid attachment means to attach the device to the cop including at least a clamping position and a release position.

According to the invention, the rapid attachment means cooperate with at least one of the ends associated with the cylindrical body of the cop and at least partly with the inner cavity of the cylindrical body.

In a first embodiment, the rapid attachment means cooperate and are in contact with the wall of the inner cavity of the cylindrical body of the cop.

According to a variant of this embodiment, the wall of the inner cavity of the cop has a circumferential groove, in a defined position, which acts as a clamping seating for a mating circumferential protrusion which is in a low position of the gripper and manipulation device.

According to another embodiment, the rapid attachment means, for example, of the type including a groove, cooperate with mating coupling means, for example of the toothed type, associated with the cylindrical body of the cop and protruding thereabove.

According to the invention, the gripper and manipulation device comprises at least an elastic action release device which takes the gripper and manipulation device from a position of constraint with respect to the cop which is to be moved to a position which allows the gripper and manipulation device to be released from the cop.

According to a first embodiment, the release position of the clamp/release device is of the unstable type and the device tends to return elastically, if not contrasted by an outside force, to the clamping position.

According to a variant, the clamping position of the clamp/release device can be made stable and stationary, for example with a bayonet system, joint or otherwise.

According to one embodiment of the invention, the drive mechanism of the release device which causes the freeing of the gripper and manipulation device from the cop is governed by the activation of elastic button means which are integrally associated with the gripper and manipulation device.

According to a variant, if the gripper and manipulation device is driven automatically, the elastic button means are governed, or can be governed, by a drive actuator.

BRIEF DESCRIPTION OF THE DRAWINGS

The attached Figures are given as a non-restrictive example, and show some preferential embodiments of the invention in diagram form, as follows.

DETAILED DESCRIPTION OF THE PREFERRED EMBODIMENTS

Figure 1A:
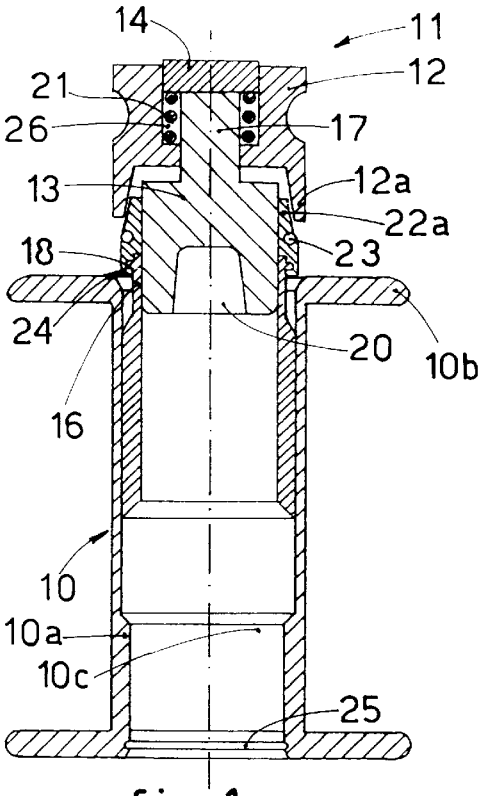
FIG. 1*a* shows a first embodiment of the gripper and manipulation device according to the invention in the release position.

The attached Figures show a small cop 10 used as a support on which the textile thread is wound in coils.

The cop 10, in this case made of metal, for example aluminium, has a central cylindrical body 10*a*, which acts as a support for the textile thread, defining an inner cavity 10*c* and having flanges 10*b* to laterally contain the wound thread at its two ends.

The device 11 according to the invention comprises a central body 13 suitable to be inserted at least partly into the inner cavity 10*c*.

In the embodiments shown here, in correspondence with at least one of its flanges 10*b*, the cop 10 has at least two protruding insertion elements 16, or a protruding circumferential insertion element 16, normally used to associate and couple several cops 10 together.

When several cops 10 are coupled together, for example by stacking, the elements 16 couple with a mating seating 25. However, these elements 16 may also be absent.

In this case, the elements 16 are provided with at least a clamping tooth 18 which extends laterally outwards.

The central body 13 is associated with a rod 17 connected at the upper part with a drive button 14. The lower portion of the drive button 14 is in contact with a spring 21 housed in a relative cavity 26.

The device 11 also comprises a gripper element 22, solid with the central body 13, and a clamp/release ring nut 12 which can be moved axially with respect to the central body 13.

The gripper element 22 is made at least partly elastic along its length by the inclusion of an elastic ring 23.

Substantially in correspondence with its lower portion, the gripper element 22 includes circumferential grooves 24 suitable to cooperate with the clamping teeth 18 solid with the central body 10*a* of the cop 10, so as to define the position of reciprocal clamping of the device 11 and the cop 10, in a defined position wherein the central body 13 is inserted inside the inner cavity 10*c*.

Figure 1B:
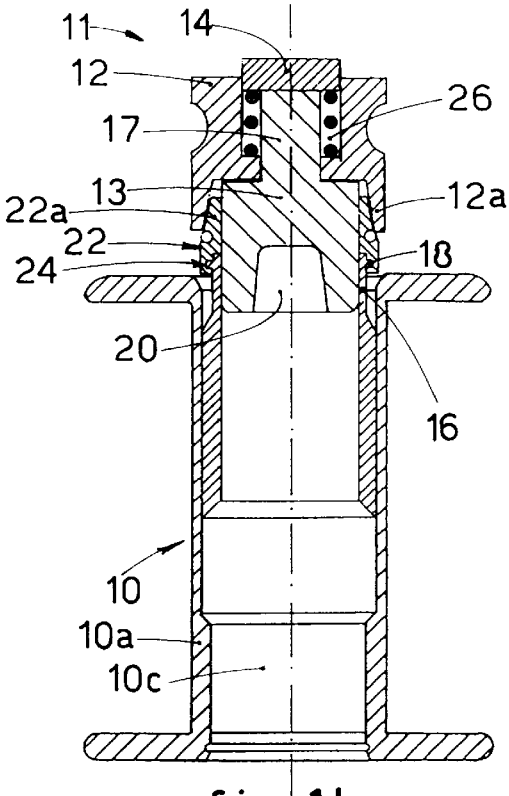
FIG. 1*b* shows the embodiment of FIG. 1 in the clamped position.

In this position when the gripper element 22 and the clamping teeth 18 cooperate, and the drive button 14 is in the release position (FIG. 1*b*), the clamp/release ring nut 12 is in a lowered position with respect to the central body 13.

In this lowered position, thanks to the cooperation of the lower inner segment 12*a* and the upper outer segment 22*a* of the gripper element 22 which connect because of their conical shape, the clamp/release ring nut 12 maintains the gripper element 22 in a state of elastic compression towards the inside and towards the axis of the cop 10. This ensures that there is a stable coupling of the clamping teeth 18 and the circumferential grooves 24 on the inner wall of the gripper element 22.

When the drive button 14 is pressed, the central body 13, and with it the gripper element 22, is lowered with respect to the clamp/release ring nut 12; this causes an at least partial release of the gripper element 22 from the ring nut 12 until the gripper element 22, thanks to the elastic ring 23, opens and releases the circumferential grooves 24 from the clamping teeth 18.

In this position (FIG. 1*a*), the device 11 can be withdrawn and released from the cop 10.

Figure 2A:
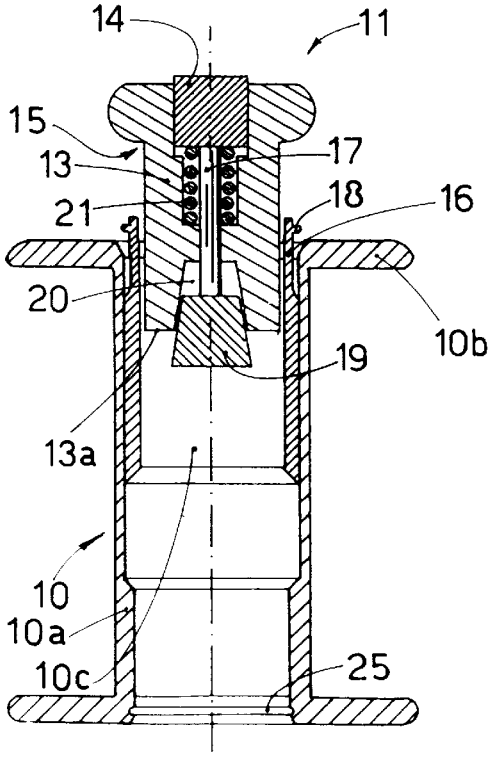
FIG. 2*a* shows another embodiment of the invention in the release position.
Figure 2B:
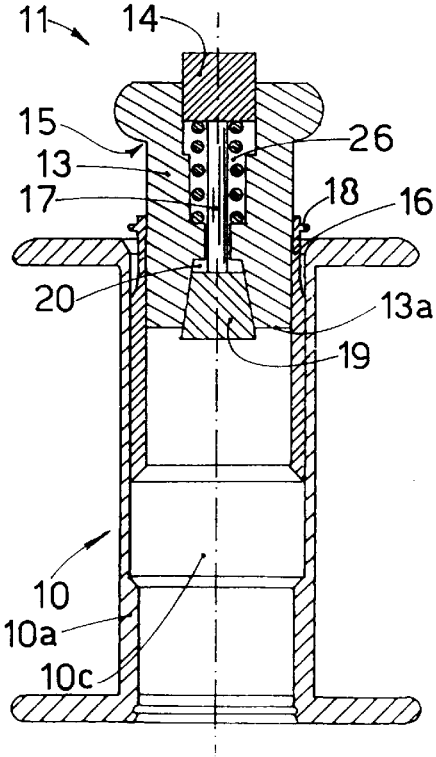
FIG. 2*b* shows the embodiment of FIG. 2*a* in the clamped position.

In the embodiment shown in FIGS. 2*a* and 2*b*, the central body 13 is axially hollow and the rod 17 can be moved axially with respect to the central body 13.

The rod 17 is associated at its upper end with the drive button 14 and at its lower end with a release element 19 substantially trapezoidal in shape.

The trapezoidal release element 19 is the same shape as and cooperates with a cavity 20 made in the lower portion of the central body 13.

The rod 17 may slide axially with respect to the central body 13, acting on the drive button 14 by means of the spring 21 housed in the cavity 26.

When the drive button 14 is in the release position, the trapezoidal release element 19 occupies a substantial part of the relative cavity 20 of the central body 13, keeping the lower edge 13*a* of the central body in an open position and thus causing the outer wall of the central body 13 to come into contact with the wall of the inner cavity 10*c* of the cop 10 (FIG. 2*b*).

This interference guarantees that the association of the device 11 and the cop 10 is sufficiently stable to allow the cop 10 to be raised and moved.

When it is desired to pass to the release position to remove the device 11 from the cop 10, the drive button 14 is pressed, the rod 17 is lowered with respect to the central body 13 compressing the spring 21 and the trapezoidal release element 19 is partly displaced to below the cavity 20.

This causes a partial elastic retraction of the lower edge 13*a* of the central body 13, because the cavity 20 is partly free, which reduces the interference with the wall of the inner cavity 10*c* and therefore makes it possible to extract the central body 13, and therefore the device 11, from the inner cavity 10*c* of the cop 10 (FIG. 2*a*).

Figure 3B:
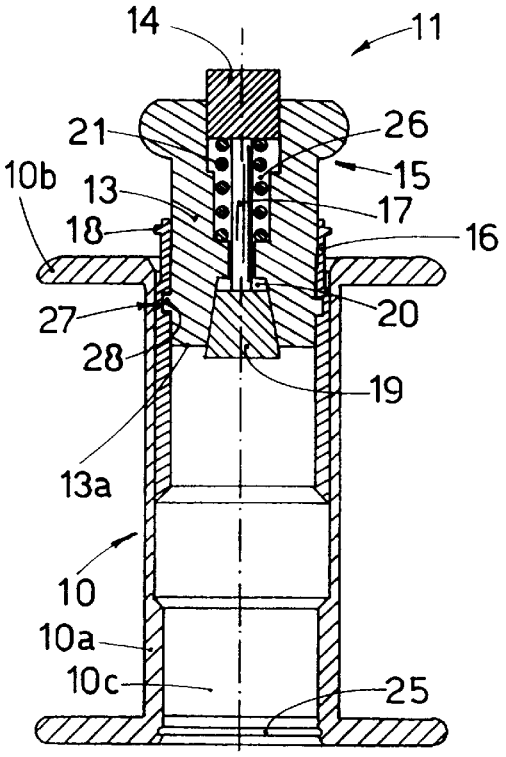
FIGS. 3*a* and 3*b* show a variant respectively of FIGS. 2*a* and 2*b;*
Figure 3A:
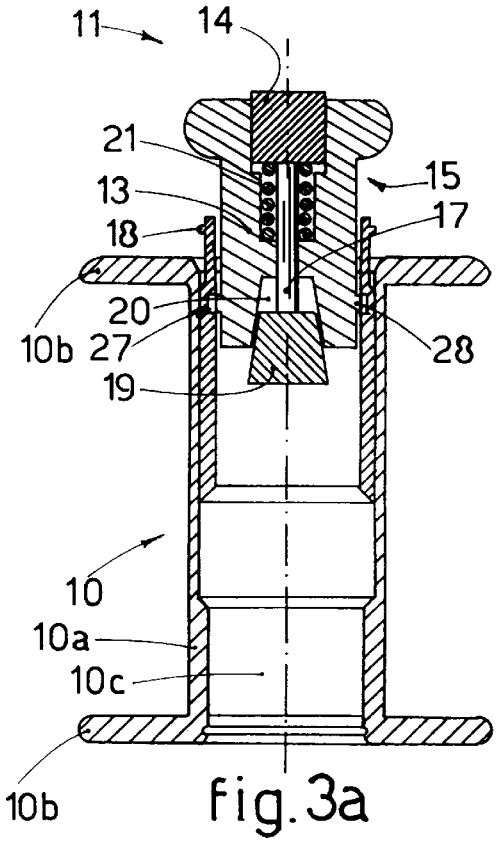

According to the variants shown in FIGS. 3*a* and 3*b*, in order to guarantee a stable and secure constraint of the device 11 and the cop 10, there is a circumferential groove 27 in a defined position on the wall of the inner cavity 10*c*, which is suitable to cooperate with a mating protrusion 28 on the lower portion of the central body 13.

In this case too, if the drive button 14 is maintained in an inactive position it causes a clamping position wherein the protrusion 28 is located inside the groove 27 (FIG. 3*b*).

When the drive button 14 is lowered, and with it the release element 19, the lower portion of the central body 13 partly retracts until it takes the protrusion 28 outside the groove 27, thus allowing the device 11 and the cop 10 to be unconstrained (FIG. 3*a*).

Figure 4:
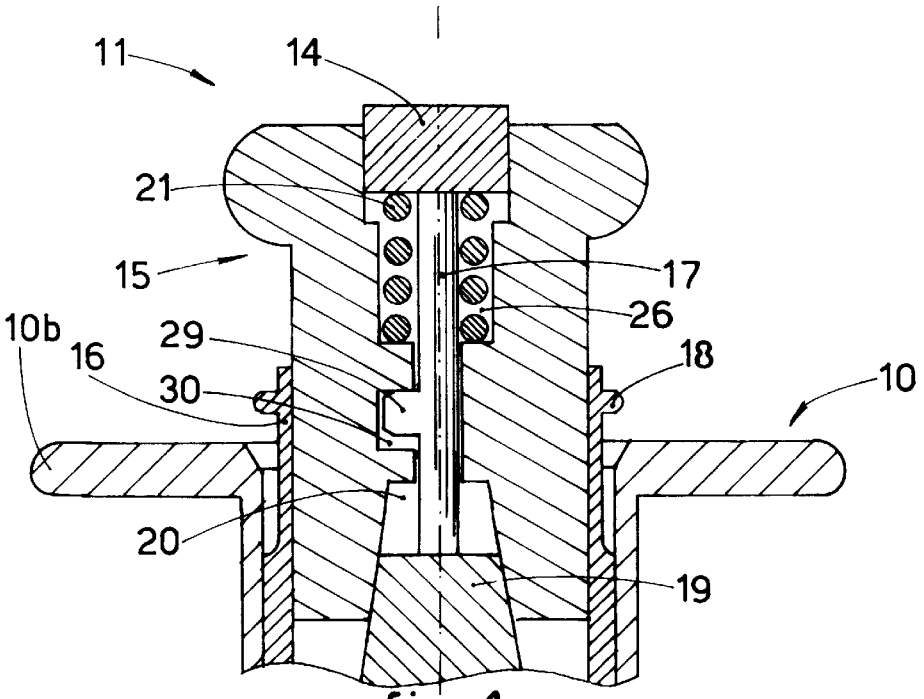
FIG. 4 shows a detail of the invention.

The release position of the gripper and manipulation device 11, normally unstable inasmuch as it tends to return to the clamping position due to the action of the spring 21, can be made stable by using an embodiment such as the one shown in FIG. 4.

In this embodiment, in a position defined by the rod 17 there is a peg 29 which, as the drive button 14 and therefore the rod 17 are lowered, can be inserted inside a mating groove 30 on the inner wall of the central body 13 adjacent to its axial cavity, for example by rotating the drive button 14. In this way, the device 11 can remain in the release position until it is next used.

The device 11 may be ergonomically shaped at the upper part, with seatings 15 for the worker's fingers to grip, or may be associated with hooks, rings or other handling means which can be associated therewith at least temporally.

What is claimed is:

1. Device to grip and manipulate bobbins of textile thread, used to grip, move and transport a cop after the textile thread has been wound on, the cop having an inner cavity and flanges at ends, the device comprising a free end having a grip portion, a central body suitable to be inserted at least partly inside the inner cavity of the cop and cooperating with the wall of the inner cavity, the central body being associated with an elastic type clamp/release device governed by the activation of at least a drive button, the clamp/release device including a first position of elastic clamping and a second release position, in which the central body has a substantially central cavity at the lower part and in which the clamp/release device comprises at least a substantially trapezoidal release element solidly associated with the drive button and movable axially with respect to the central body, the release element including a first position of elastic clamping wherein it is associated with a substantial portion of the walls of the cavity and causes the position of maximum opening of at least part of the central body and a second, lowered release position wherein it partly frees the cavity and allows the central body to at least partly retract so that it can be withdrawn.

2. Device as in claim 1, in which in the second, lowered release position of the trapezoidal release element, the contact between the outer wall of the central body and the wall of the inner cavity of the cop is at least partly limited.

3. Device to grip and manipulate bobbins of textile thread, used to grip, move and transport a cop after the textile thread has been wound on, the cop having an inner cavity and flanges at ends, the device comprising a central body suitable to be inserted at least partly inside the inner cavity of the cop and cooperating with the wall of the inner cavity, the central body being associated with an elastic type clamp/release device governed by the activation of at least a drive button, the clamp/release device including a first position of elastic clamping and a second release position, in which the central bodv has a substantially central cavity at the lower part and in which the clamp/release device comprises at least a substantially trapezoidal release element solidly associated with the drive button and movable axially with respect to the central body, the release element including a first position of elastic clamping wherein it is associated with a substantial portion of the walls of the cavity and causes the position of maximum opening of at least part of the central body and a second, lowered release position wherein it partly frees the cavity and allows the central body to at least partly retract so that it can be withdrawn, and in which the central body includes, in a low portion thereof, a circumferential protrusion cooperating and coupled with a mating circumferential groove in the wall of the inner cavity of the cop.

4. Device as in claim 3, in which in the second, lowered release position of the trapezoidal release element the circumferential protrusion is positioned outside the circumferential groove.

5. Device to grip and manipulate bobbins of textile thread, used to grip, move and transport a cop after the textile thread has been wound on, the cop having an inner cavity and flanges at ends, one end of the cop having a protruding insertion element having clamping teeth, the device comprising a central body suitable to be inserted at least partly inside the inner cavity of the cop and cooperating with the wall of the inner cavity, the central body being associated with an elastic type clamp/release device governed by the activation of at least a drive button, the clamp/release device including a first position of elastic clamping and a second release position, and in which a gripper element is solidly associated with the central body and includes, at its lower part, a circumferential groove suitable to cooperate and couple with the clamping teeth on the protruding insertion element, and in which the elastic-type clamp/release device comprises a clamp/release ring nut which has the same shape as and cooperates with the upper part of the gripper element so as to compress the groove, in the clamping position, inwards against the clamping teeth.

6. Device as in claim 5, in which the clamp/release ring nut has a first raised position of release wherein it is at least partly released from the upper part of the gripper element and a second lowered clamping position wherein it exerts an elastic compression on the upper part of the gripper element.

7. Device as in claim 5, in which the gripper element is made more elastic by the inclusion of an elastic ring.

8. Device as in claim 5, in which the upper part of the gripper element and the clamp/release ring nut are coupled in shape by surfaces shaped like a truncated cone tapering upwards.

* * * * *